US006076809A

United States Patent [19]

Cummins et al.

[11] Patent Number: 6,076,809

[45] Date of Patent: Jun. 20, 2000

[54] FLUID MIXING APPARATUS HAVING A CONDENSING TUBE ARRAY

[75] Inventors: Richard D. Cummins, Orchard Park; Jack A. Perry, Lewiston, both of N.Y.

[73] Assignee: Q Jet DSI, Inc., North Haven, Conn.

[21] Appl. No.: 09/113,739

[22] Filed: Jul. 10, 1998

[51] Int. Cl.[7] ..... B01F 3/04

[52] U.S. Cl. ..... 261/62; 261/64.1; 261/76; 261/137; 261/DIG. 10; 366/182.4; 366/341

[58] Field of Search ..... 261/43, 44.1, 53, 261/62, 64.1, 76, 137, 152, DIG. 10, DIG. 32, DIG. 76; 366/101, 150.1, 167.1, 173.1, 173.2, 176.2, 182.1, 182.3, 182.4, 341

[56] References Cited

U.S. PATENT DOCUMENTS

| | | | |
|---|---|---|---|
| 2,202,573 | 5/1940 | Coppock | 127/28 |
| 2,385,200 | 9/1945 | Friedel | 261/76 |
| 2,747,974 | 5/1956 | Felger | 261/76 |
| 3,450,800 | 6/1969 | Smith et al. | 261/76 |
| 3,706,534 | 12/1972 | Verheul et al. | 261/76 |
| 3,984,504 | 10/1976 | Pick | 261/76 |
| 4,701,194 | 10/1987 | Weyers et al. | 261/76 |
| 4,732,712 | 3/1988 | Burnham et al. | 261/64.3 |
| 5,743,638 | 4/1998 | Cummins et al. | 366/163.2 |
| 5,820,259 | 10/1998 | Cummins et al. | 261/DIG. 76 |

*Primary Examiner*—C. Scott Bushey
*Attorney, Agent, or Firm*—Sofer & Haroun, LLP

[57] ABSTRACT

A fluid mixing apparatus for mixing a first fluid with a second fluid and to prevent acoustic hammer effects, utilizing a condensing tube array. In accordance with one embodiment of the invention, a direct steam injection process heater is provided, having a first body for introducing a first fluid, generally a liquid or slurry, a second body for introducing a second fluid, generally steam, an orifice plate disposed between the two bodies, and a valve member for movement to and away from the orifice plate. The orifice plate has a plurality of frusto-conical holes which are engaged preferably by an equal number of complementary-configured, conically-tipped pins mounted onto the valve member. An actuator moves the valve member relative to the orifice plate such that the pins penetrate and partially or wholly obscure the holes, thus regulating the flow of the second fluid through the holes. The mixing area of the first body is equipped with a condensing tube array, having a plurality of condensing tubes rigidly secured in relation to each other by a plurality of retaining rings and secured in the first body by a plurality of studs. The condensing tubes are preferably arranged such that their longitudinal axes coincide with the longitudinal axes of the pins and the center points of the holes, and such that an annular space exists between the entrance end of the condensing tube and the face of the orifice plate.

20 Claims, 4 Drawing Sheets

FLUID MIXING APPARATUS HAVING A CONDENSING TUBE ARRAY

FIELD OF THE INVENTION

The present invention is directed to a fluid mixer. More particularly, the invention provides a condensing tube array for reducing acoustic hammer effects when a process fluid or slurry is injected with high pressure steam through a direct steam injection process heater utilizing a multi-orifice array (Micro-Jet Array™).

BACKGROUND OF THE INVENTION

Several methods and techniques have been developed to introduce steam into a process fluid or slurry to warm, cook or purify the process fluid or slurry. Some examples of the prior art include spargers, mixing tees, venturi-type injection systems and modulating injection systems.

U.S. Pat. No. 2,202,573 to Coppock discloses an early mixing jet cooking device. The Coppock device is comprised of a single orifice steam ejector in which a continuous stream of steam was mixed with a liquid or slurry, generally comprised of an amylaceous material. The Coppock device was comprised of a vertical cylindrical chamber through the top of which a downwardly converging steam nozzle is projected for supplying steam from a pipe controlled by a valve. The steam nozzle extends proximate the mouth of a downwardly divergent delivery nozzle coaxial with the steam nozzle and which projects upwardly inside the chamber from the base and continuing in the form of a delivery pipe. At the point where the steam nozzle and the delivery nozzle met, a flour suspension feed chamber was laterally connected for supplying the flour suspension into the path of steam provided by the steam nozzle. The flour then becomes cooked by the heat of the steam which condenses and the paste collects in a steadying chamber and is finally passed out through an exit pipe.

In addition to U.S. Pat. No. 2,202,573 there exists other devices such as described in U.S. Pat. No. 3,984,504 to Pick and U.S. Pat. No. 4,732,712 to Burnham et al. The Pick device is essentially a variable pressure modulatable Sparger Tube contained within a process flow tube whose construction encompasses a number of moving parts and very small steam orifices. As such, the device is subject to clogging, plugging and steam hammering, particularly when used to heat slurries, and in many cases, when used to heat solutions with dissolved solids concentrations in excess of 1%.

The device described by Burnham is an internally vained mixing tee with a separate steam flow control valve. Thus, it constitutes a variable steam pressure device within the fixed volume mixing tee. While this heater has fewer moving parts than the Pick device, it fails to provide broad rangeability and is subject to steam hammer when its operating parameters exceed narrow limits within each units operational configuration, i.e.—delta T, steam flow, and process fluid flow.

Mixing jet cooking devices, such as those produced by Q-JET® or the Hydro-Heater™ produced by Hydro-Thermal Corporation, continue to utilize separate steam and liquid/slurry inlets, often having attached valves to control the inflow of steam or liquid/slurry, respectively. U.S. Pat. No. 5,743,638 to Cummins/Perry, directed to a "Dual Control Mixing Jet Cooker", describes an actuator connected to the cooking device that provides a steam jet that enters the cooking device. The steam and liquid inlets converge in a "combining" or "mixing" tube, which is an open ended cylinder through which the steam jet shoots. Between the open end of the Venturi and the skirt of the steam jet nozzle is a gap which permits the liquid or slurry to be drawn into the Venturi where it mixes with the jet of steam and condenses, heating the slurry which is expelled out of the mixing tube as a paste.

The single-orifice steam ejector of the prior art has been improved upon by a multi-orifice plate, which is advantageously disposed between the steam source and the mixing tube. The multi-orifice plate comprises a circular disk or plate-like member having a plurality of holes. The holes are arranged to operatively engage with an equivalent number of similarly arranged, conically-tipped pins. The pins are mounted on a valve member which, under the force of an actuating means, move into and out of the holes on the orifice plate in order to regulate the flow of steam from the steam source into the mixing tube, thus forming a multi-jet array. The multi-jet array enables the disbursement of high pressure steam into the process feed from a plurality of equal-pressure small jets, permitting intimate contact of a greater cold process flow surface area with the steam, which results in rapid to instantaneous steam condensation.

While a micro-jet array accomplishes the objective of quick condensation when heating relatively cold feed materials and discharging the heated flow into atmospheric conditions, it encounters acoustical steam hammer difficulties when applied to process flows at elevated process feed temperatures, i.e.—approaching the atmospheric boiling point of the process fluid. This is particularly true when processing materials requiring heated temperatures in excess of the atmospheric boiling temperature of the fluid or medium and/or utilizing a low pressure steam supply (30–70 PSIG), coupled with low temperature differential requirements. The collapse of a steam bubble within a pipe or other vessel and/or the subsequent jarring contact of the condensed gas into the piping or equipment is referred to as "steam hammer". Steam hammer is experienced as a loud noise and the violent vibration of the pipes, vessels or other equipment in the immediate vicinity. The loud noise is undesirable as, by itself or in combination with the noise of other operating machinery in the vicinity, it can cause discomfort or hearing loss to persons in the work environment. The violent vibration of the equipment also causes the disintegration of components in the equipment, increasing maintenance costs and increasing the likelihood of a system failure or of an injury to a person in the work environment.

Therefore, there exists a need for a fluid mixer, such as a direct steam injection heater, which provides a broad range of operation with freedom from acoustical steam hammer.

OBJECTS AND SUMMARY OF THE INVENTION

Accordingly, it is a general object of the present invention to prevent acoustic hammer effects when a first fluid is mixed with a second fluid by a fluid mixing apparatus.

A further object of the present invention is to prevent acoustic hammer effects in a direct steam injection process heater utilizing a multi-orificed, micro-jet array configuration.

A still further object of the present invention is to provide a condensing tube array to prevent acoustic hammer effects.

A still further object of the present invention is to provide a method and apparatus for controlled condensation, thus preventing steam hammering when a process fluid or slurry is mixed with high pressure steam through a multi-orificed, direct steam injector.

A still further object of the present invention is to achieve a direct steam injection heating device which instantaneously condenses a steam flow in a short a distance as possible.

A still further object of the present invention is to achieve exposure of high pressure steam to as great a surface area of cold flow process flow material as possible.

In accordance with one embodiment of the present invention, a fluid mixing apparatus, such as a direct steam injection heater, is provided, comprising a first body for introducing a first fluid, generally a liquid or slurry, a second body for introducing a second fluid, generally steam, an orifice plate disposed between the two bodies, and a valve member for movement to and away from the orifice plate. The orifice plate has a plurality of frusto-conical holes which are engaged preferably by an equal number of complementary-configured, conicallytipped pins mounted onto the valve member. An actuator moves the valve member relative to the orifice plate such that the pins penetrate and partially or wholly obscure the holes, thus regulating the flow of the second fluid through the holes. The mixing area of the first body is equipped with a condensing tube array, comprising a plurality of condensing tubes rigidly secured relative to each other by a plurality of retaining rings and secured within the first body by a plurality of studs. The condensing tubes are preferably arranged such that their longitudinal axes coincide with the longitudinal axes of the pins and with the center points of the holes, and such that an annular space exists between the entrance end of the condensing tube and the face of the orifice plate.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, in which like reference characters denote similar elements throughout the several views.

DETAILED DESCRIPTION OF THE PRESENTLY PREFERRED EMBODIMENTS

The present invention is directed to a device for reducing acoustic hammer effects when mixing two fluids. Specifically, it provides a condenser tube array for use, according to one embodiment of the invention, during the heating and processing of process fluids and slurries by a direct steam injection process heater utilizing a multi-orificed, micro-jet array. Broadly, the invention has applicability to chemical processes such as found in the processing of food, candies and alcohol, as well as pulp, paper, pharmaceuticals, textile and oil, gas and petrochemical processing, but is most particularly suited for those processes in which direct steam injection is used to heat a process fluid or slurry through the above-mentioned type of apparatus.

Figure 1:
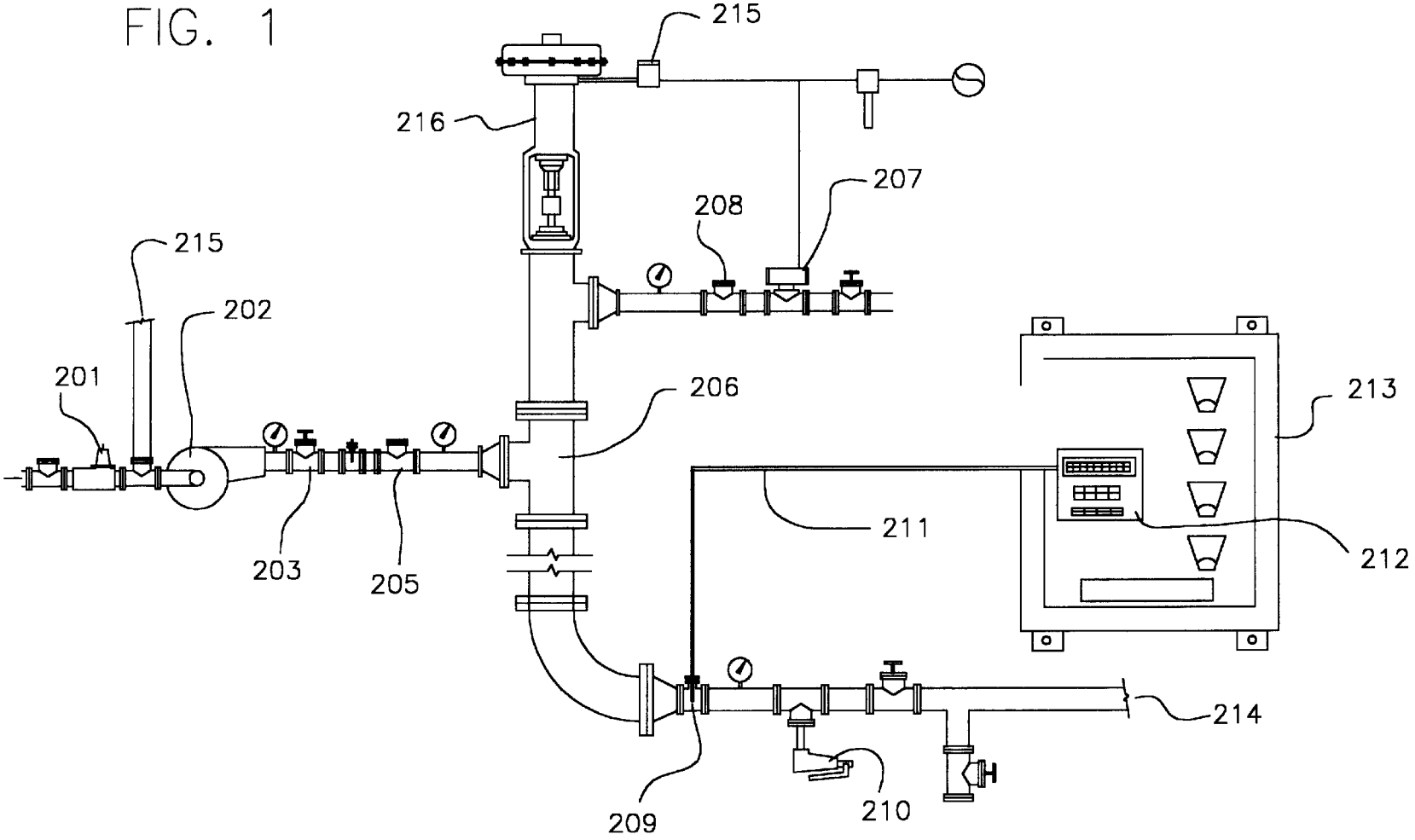
FIG. 1 is a schematic representation of a process heating system utilizing a multi-jet array heater encompassing a condensing tube array, in accordance with one embodiment of the present invention.

With initial reference to FIG. 1, there is provided, solely for the illustrative purpose of describing the process in which the device of the invention functions, a schematic illustration which traces a typical commercial process heating system for the heating of water supplied to a drying process as the heat transfer medium. The process commences at supply water pressure regulator/reducing valve 201 with the introduction of water to loop recirculation pump 202. Isolation valve 203 provides means for system isolation from its source. Flow switch 204 insures that adequate process flow water is supplied to the process heater 206 and, through action of control panel 213, enables the opening or closing of steam supply block valve 207. As soon as process fluid or slurry is detected flowing by flow switch 204, steam block valve 207 opens enabling high pressure steam to flow into the upper steam body (see FIG. 2) of process heater 206. At this point, it is distributed under equal pressure to all of the orifices in the orifice plate (to be explained fully later) under the proportional control of the valve head assembly (also explained later) as regulated by PID controller 212 of the control panel 213.

RTD temperature sensors 209 detect the heated water temperature as transmitted to PID controller 212, which sends a proportional 4–20 mA signal to I/P transducer 215. I/P transducer 215 outputs a 6–30 PSIG signal to the pneumatic diaphragm actuator 216 mounted on the valve stem of the process heater. The process heating water is recirculated throughout the system by loop pump 202 and operating pressure in the system is maintained by the loop safety relief valve 210 and water supply pressure regulator 201. It is understood that the process heretofore described may be altered depending on the fluid or slurry being heated. For example, more valves may be required or additional components added to the slurry to facilitate operability and control of the system, such as a distributed control system. For instance, certain heating systems may require a magnetic flowmeter in place of flow switch 204 or may not utilize a constant volume thru-put substituting a standpipe with sufficient head to maintain the desired system operating pressure.

Figure 2:
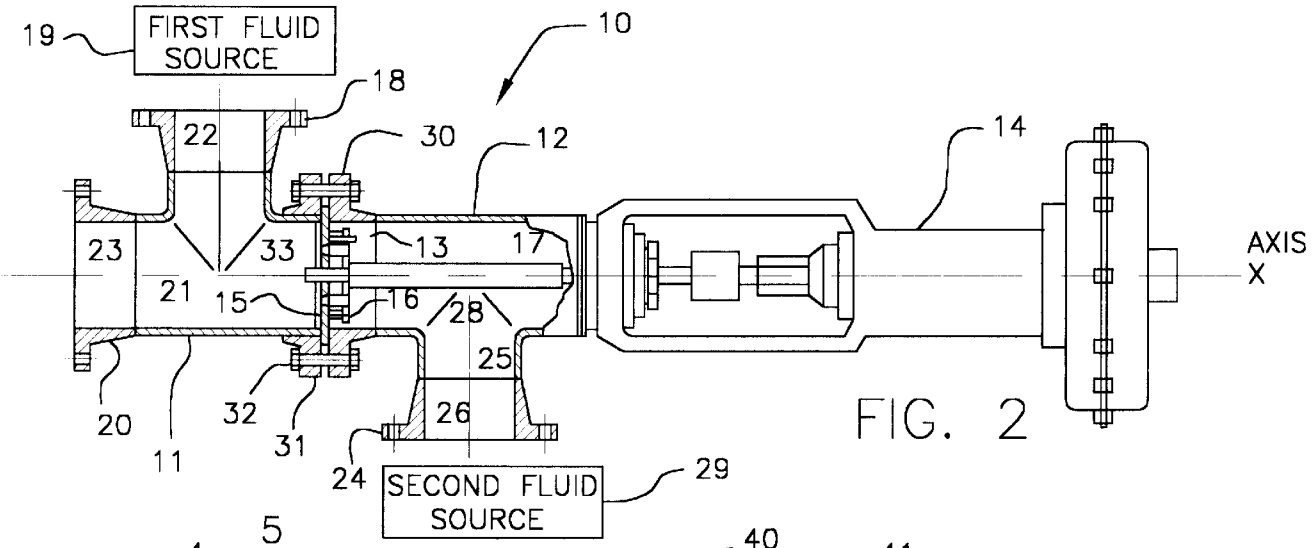
FIG. 2 is a view, partly in longitudinal cross-section and partly in elevation, of a micro-jet array process heater in accordance with one embodiment of the present invention, this view showing the first body, the second body, the orifice plate, the valve member, and the actuator operatively arranged to move the valve member toward and away from the orifice plate.

FIG. 2 illustrates the internal workings of a first embodiment of the fluid mixing apparatus 10 of the present invention, here shown as a micro-jet array process heater, for mixing a second fluid 29, generally steam, with a first fluid 19, generally a process fluid or a slurry mixture to be heated by the steam. The apparatus 10 comprises a first body 11, a second body 12, a connecting passageway 13, an actuator 14, an orifice plate 15 and a valve member 16 operatively associated with the extensible and retractable rod 17 of the actuator for movement toward and away from orifice plate 15. First body 11 is shown in FIG. 2 as being a conventional pipe tee, though FIG. 6, which will be explained fully later, shows additional features of first body 11 which are not shown in FIG. 2. Flanged fitting 18 is mounted on the inlet portion 22 of first body 11 and communicates with first fluid source 19. Second fitting 20 is mounted on the combined fluid outlet 23 of first body 11, for flanged attachment to downstream processes (not shown). Flanged fittings 18, 20 are suitably secured to first body 11 by annular weldments, though other securing means, such as threading, are contemplated. Thus, first body 11 has a first fluid passageway 21, which extends between inlet portion 22 and combined fluid outlet 23. First fluid source 19 is operatively connected with inlet portion 22 to cause a flow of first fluid 19 through first fluid passageway 21.

In one embodiment of the invention, second body 12 is a conventional pipe tee, albeit this tee is shown as being rotated 180 degrees about an axis x, as shown in the drawing. It should be noted that this rotation about axis x, of any number of degrees including the 180 degrees shown, is not essential for the present invention to operate as described herein. Flanged fitting 24 is mounted on the inlet portion 22 of second body 12 by means of a peripheral weldment. Actuator 14 is operatively mounted on marginal end portion of second body 12, such that rod 17 sealingly enters the second body cavity. Second body 12 has second fluid passageway 25 extending between inlet portion 26 and outlet portion 28. Second body inlet 26 is associated with second fluid source 29. Thus, second fluid 29 flows from source 29 through inlet 26 and passageway 25 to outlet portion 28.

Connecting passageway 13 is shown as being provided by flanged section 30. Flanged ring 31 is mounted on inlet portion 33 of first body 11, and is operatively secured in this position by means of an annular weldment. Flanged section 30 is shown as being connected to the outlet end 28 of second body 25 by means of an annular weldment. Flanged sections 30, 31 are joined by a plurality of fasteners, such as nuts and bolts, one of which is indicated at 32. Thus, flanged sections 30, 31 provide a connecting passageway 13 which operatively joins outlet portion 28 of second body 12 with inlet portion 33 of first body 11.

Figure 4:
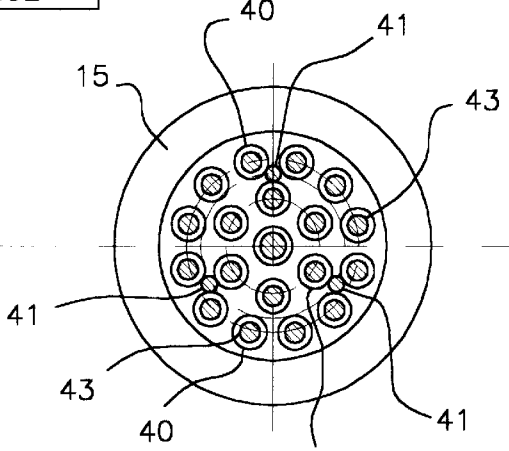
FIG. 4 is a transverse vertical sectional view thereof, showing the orifice plate of FIG. 3 in right side elevation, in accordance with one embodiment of the present invention.
Figure 5:
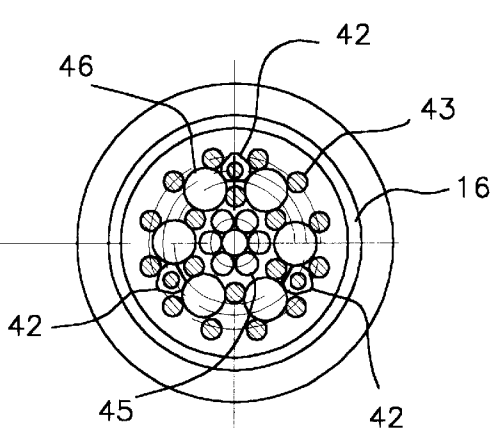
FIG. 5 is a transverse vertical sectional view thereof, showing the valve member of FIG. 3 in right side elevation, in accordance with one embodiment of the present invention.
Figure 3:
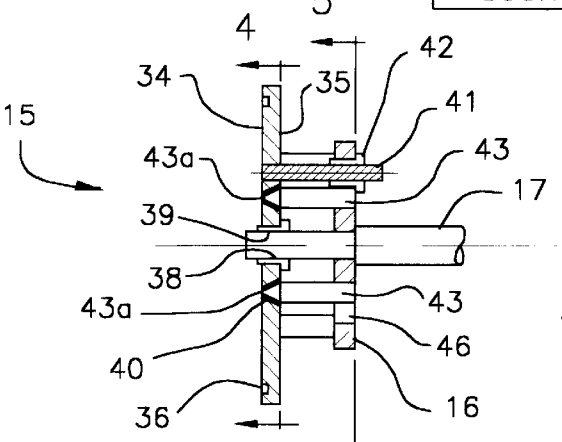
FIG. 3 is a fragmentary enlarged detail view of the orifice plate and the valve member shown in FIG. 2, this view showing the distal ends of the pins carried by the valve member as being received in the frusto-conical mouth of the orifice plate holes, in accordance with one embodiment of the present invention.

Orifice plate 15 is more clearly shown in FIGS. 3, 4 and 5, as being a circular or platelike member having its outer periphery compressively disposed between the facing surfaces of flange members 30, 31. It should be noted that orifice plate 15 may be secured in place between first and second bodies 11, 12 in any one of several different manners, e.g.—orifice plate 15 has two opposite facing flanges of its own (not shown), which themselves fasten to flanges 30 and 31 respectively. As shown, orifice plate 15 has surface 34 arranged to face into first body passageway 21, and surface 35 arranged to face toward second body passageway 25. In the embodiment shown, annular groove 36 extends into the orifice plate on surface 34 to receive and accomodate an 0-ring, which seals the joint between orifice plate 15 and flange ring 31. Orifice plate 15 is also shown as being provided with an axial through-hole 38 in which a slide bushing 39 is operatively mounted.

Orifice plate 15 is further shown as having a plurality of holes, severally indicated in FIGS. 3 and 4 at 40, provided therethrough. The holes 40, in the embodiment shown in FIG. 4, are arranged in two concentric rings, although it is recognized that numerous rings, or other configurations, are possible. In the drawing, there are six holes in the inner ring and twelve holes in the outer ring. Each of holes 40 has a frusto-conical portion disposed such that the largest part of the conical shape, i.e.—the largest opening, is located at face 35 of orifice plate 15. The conical shape or opening becomes progressively smaller closer to face 34 of orifice plate 15, until the conical shape of the hole edges becomes an inwardly facing cylindrical portion continuing therefrom to join orifice plate face 34. Orifice plate 15 is also provided with additional holes, in this embodiment three holes spaced at equidistant intervals 120 degrees apart, to receive and accomodate an equal number of guide pins 41. One end of guide pins 41 are fixedly mounted to orifice plate 15, and the other end penetrates through and slidably engages with slide bushings 42 carried by the valve member. One end of actuator rod 17 is shown as having a reduced-diameter portion extending through valve member 17 and slide bushing 39.

In the embodiments that can be seen in FIGS. 3 and 5, valve member 16 is a circular plate-like member mounted fast to the end portion of actuator rod 17. Valve member 16 has a plurality of holes therethrough. Pins, severally indicated at 43, have their rear end portions fixed in these holes and have their conical tips 43*a* arranged for movement into and out of engagement with the holes 40 provided by orifice plate 15. Pins 43 have conical end portions which are configured complementary with respect to the frusto-conical mouths of holes 40 to vary the orifice areas through which fluid may flow from the second passageway 28 into first passageway 21. Valve member 16 is also shown in FIG. 5 as including two other groups of holes, large valve member holes 46 and small valve member holes 45, which permit second fluid 29 to pass through valve member 16 toward orifice plate 15.

Guide pins 41 penetrate slide bushings 42 provided in valve member 16 to assist in movement of valve member 16 toward and away from orifice plate 15. Guide pins 41 also prevent relative rotation between valve member 16 and orifice plate 15 in the embodiment shown. FIG. 4 shows one possible arrangement of holes 40 within orifice plate 15, and the manner in which guide pins 41 prevent said rotational movement. The figure illustrates pins 43 of valve member 16 aligned in two concentric circular patterns with holes 40 of orifice plate 15.

First fluid from source 19 may flow through the L-shaped first passageway 21 between inlet 22 and leftward outlet 23. Second fluid, which is typically more highly pressurized and is primarily contemplated to be steam, may flow from source 29 through second body passageway 25 and pass through orifices formed by the extent to which the distal end of pins 43 uncover frusto-conical portions of holes 40, to mix with the first fluid. The first fluid is primarily contemplated to be a process fluid or slurry.

Figure 6:
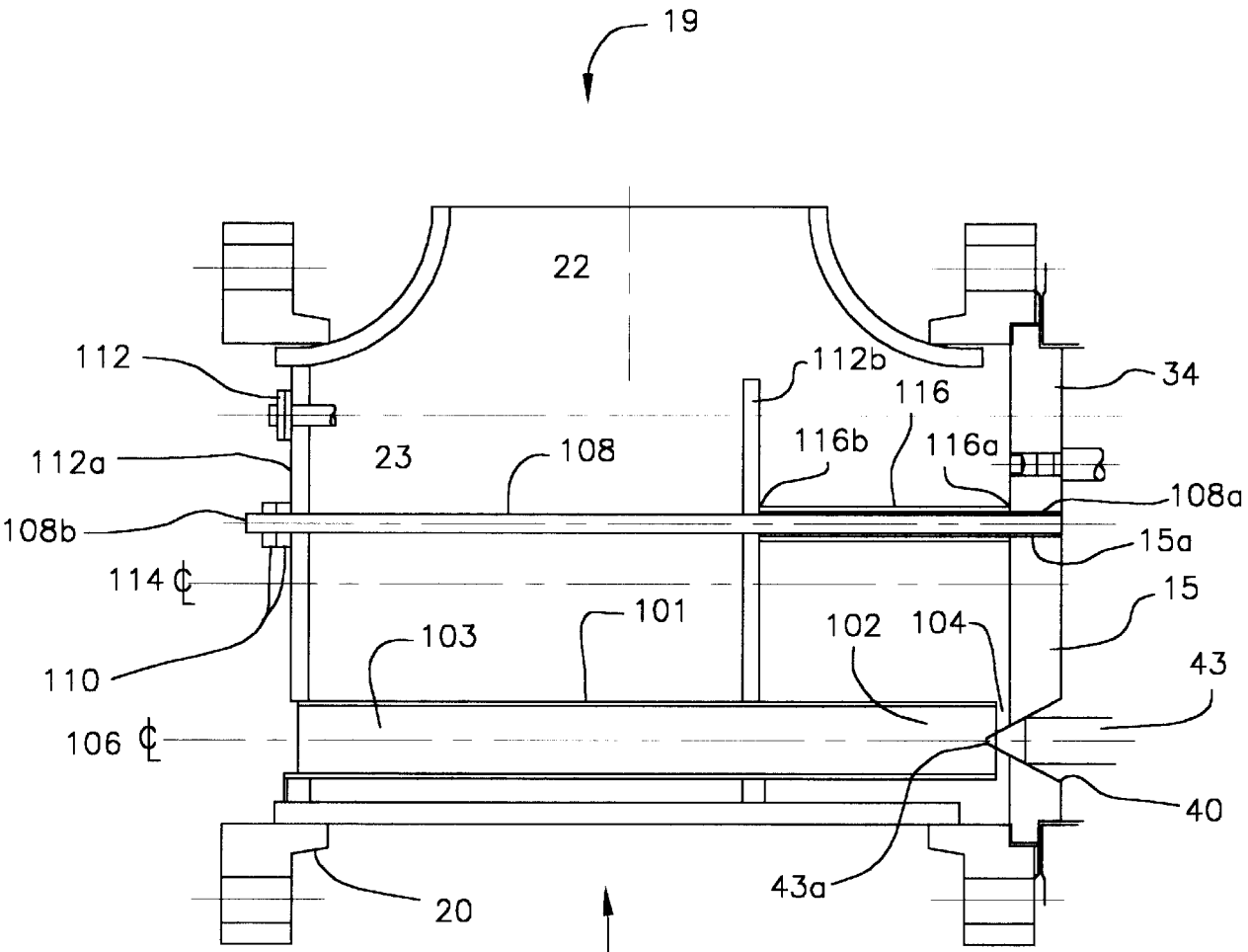
FIG. 6 is a longitudinal vertical cross-section showing the condensing tube array disposed within the first body, in accordance with one embodiment of the present invention.

FIG. 6 illustrates additional features of first body 11 but not previously illustrated or discussed, particularly condensing tube array 100. Condensing tube array 100 comprises a plurality of condensing tubes 101, rigidly secured to a plurality of retaining rings 112 and secured in first body 11 by a plurality of studs 108.

As previously discussed, pins 43, only one of which is shown in FIG. 6, obscure holes 40 such that the amount of second fluid 29 which flows through holes 40 is determined by the relative position of pins 43 in relation to holes 40. As shown in the diagram, center line 106 is the longitudinal axis of pin 43 as well as the center point of hole 40. Condensing tubes 101, only one of which is shown in FIG. 6, is disposed within first body 11 such that its longitudinal axis also corresponds to center line 106. In the preferred embodiment, a condensing tube 101 exists for each such hole 40 and pin 43 setup, whereby each such condensing tube 101 also shares its longitudinal axis with the centerline of each such hole 40 and center point of each such pin 43. End 102 of condensing tube 101 is disposed such that space 104 exists between end 102 of condensing tube 101 and face 34 of orifice plate 15.

In order to maintain condensing tubes 101 in the proper position, such that the longitudinal axis of each condensing tube 101 is coaxial with the longitudinal axis of pins 43 and the center points of holes 40, each condensing tube 101 is securely mounted to a plurality of retaining rings 112. Retaining rings 112 are preferably a circular, plate-like rigid disk, into which has been disposed a plurality of holes. These plurality of holes are preferably arranged such that they are identical to the pattern of holes 40 in orifice plate 15, and have an inside diameter which is just slightly larger than the outside diameter of condensing tubes 101. In this manner, condensing tubes 101, can be passed through the arrangement of holes in retaining rings 112, which is also identical to the pattern of holes 40 in orifice plate 15. Advantageously, condensing tubes 101 are rigidly secured to retaining rings 112, such as by welding them together.

In the embodiment shown, two retaining rings 112*a* and 112*b* are shown, one at the end 103 of condensing tube 101, and one about half way between ends 102 and 103 of condensing tubes 101. The second retaining ring 112*b* provides additional rigidity to ensure that condensing tube 101 is not moved, into a configuration which does not match the arrangement of the pattern of holes 40 in the orifice plate 15, during operation. It should be noted however, that a single retaining ring, or multiple retaining rings are within the contemplation of the present invention.

Additionally, FIG. 6 shows stud 108, which in this embodiment is mounted to orifice plate 15. As shown, end 108*a* of stud 108 is threadedly engaged with hole 15*a* of orifice plate 15. Stud 108 assists in positioning condensing tubes 101 a desired distance away from face 34 of orifice plate 15. Stud 108 also helps in positioning condensing tubes 101 rotationally about centerline 114 of the condensing tube array 100, so as to line up pins 43 with holes 40 in orifice plate 15. In the embodiment shown, stud 108 extends through first body 11, and through retaining rings 112*a* and 112*b*. Threaded nuts 110 threadedly engage end 108*b* of stud 108 so as to rigidly secure retaining ring 112*a* into position. By securing retaining ring 112*a* into place, nuts 110 also secure condensing tube array 100 into place because, as previously mentioned, retaining ring 112*a* is itself a rigid member of condensing tube array 100.

As mentioned previously, end 108*a* of stud 108 is threadedly engaged with threaded hole 15*a* of orifice plate 15. Hole 15*a* is advantageously located on orifice plate 15 such that, when end 108*a* and hole 15*a* are engaged, condensing tube array 100 is rotationally positioned such that the longitudinal axes of condensing tubes 101 line up with the center point of holes 40 and the longitudinal axes of pins 43. Stud tube 116 is also advantageously employed to position condensing tube array 100. In the embodiment shown, end 116*a* of stud tube 116 is rigidly secured, preferably welded, to retaining ring 112*b*. Stud tube 116 is slightly longer in length than the distance from retaining ring 112*b* to end 102 of condensing tube 101. In this manner, when end 116*a* of stud tube 116 contacts orifice plate 15, end 102 of condensing tube 101 is not in contact with orifice plate 15, and space 104 is created. Thus, space 104 is maintained by the contact between end 116*a* and orifice plate 15, and space 104 can be suitably adjusted by shortening or lengthening stud tube 116 as desired.

In one embodiment, studs 108 are not secured to retaining rings 112, but instead, retaining rings 112 have holes through which studs 108 pass. In this manner, by removing nuts 110 from end 108*b* of stud 108, condensing tube array 100 can be removed from inside first body 11 (for cleaning, maintenance, etc.) by pulling the array out through outlet 23. Studs 108 would remain in first body 11 since they are threadedly engaged to orifice plate 15. When condensing tube array 100 was replaced in first body 11, studs 108 would be made to pass through the same holes in retaining rings 112, thus assuring that condensing tube array 100 would be rotationally positioned the same as prior to its removal.

Other configurations may also exist with regard to studs 108. For instance, studs 108 may be rigidly secured, as by welding, to condensing tube array 100. In this configuration (not shown), end 108*a* of stud 108 contacts orifice plate 15, but is not threadedly engaged therewith to orifice plate 15. This configuration permits space 104 to be maintained but does not provide a means for rotationally positioning condensing tube array 100 in first body 11 to ensure that the longitudinal axes of condensing tubes 101 line up with the longitudinal axes of pins 43 and the centerpoints of holes 40.

The overall length of condensing tube array 100, also corresponding to the end to end length of condensing tubes 101, is also determined by the preference of the user. In the embodiment shown in FIG. 6, the overall length of condensing tube array 100 is approximately the same length as first body 101. In this embodiment, retaining ring 112*a* is disposed near outlet 23, such that the majority of first fluid 19 entering first body 11 is restricted from flowing through outlet 23. Instead, first fluid 19 flows toward orifice plate 15 and is forced to flow into space 104. Upon entering space 104, first fluid 19 is pushed by second fluid 29, itself flowing through holes 40 in orifice plate 15, into ends 102 of condensing tubes 101. Thus, the mixture of first fluid 19 and second fluid 29 flows through the center of condensing tubes 101 from end 102 and out of end 103.

In another embodiment (not shown), condensing tube array 100 is shorter than the length of first body 11. In this embodiment, retaining ring 112*a* is not disposed near to outlet 23 and thusly does not restrict all of the flow of first fluid through outlet 23. Some flow occurs through outlet 23 and some flow occurs through condensing tubes 101 from end 102 to end 103. Thus, partially mixed fluids 19 and 29 would flow through the condensing tubes where the mixture would further mix with first fluid 19 which flowed immediately through outlet 23. Such an arrangement might be advantageous to minimize the restriction of the flow of first fluid 19 through the process.

Figure 7:
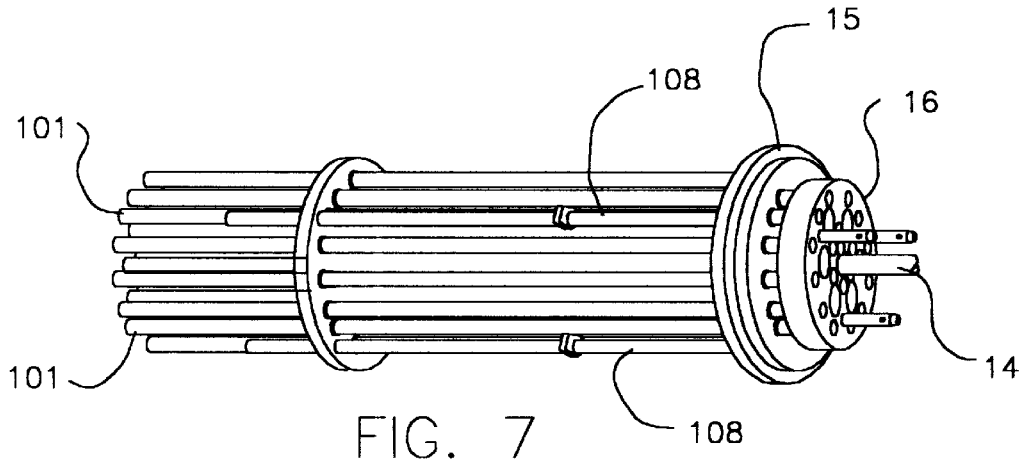
FIG. 7 is a perspective view showing the condensing tube array, orifice plate and valve member, in accordance with one embodiment of the invention.

FIG. 7 illustrates condensing tube array 100, orifice plate 15 and valve member 16, assembled for installation but prior to installation in first and second fluid passageways 21 and 25, in accordance with one embodiment of the invention. Orifice plate 15 is disposed between condensing tube array 100, on the left side of the figure, and valve member 16, on the right side of the figure.

Figure 8:
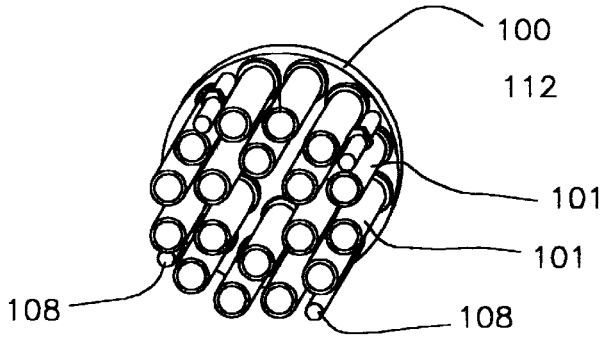
FIG. 8 is a perspective view showing the entrance ends of the condensing tube array arranged in two concentric circles, in accordance with one embodiment of the invention.

FIG. 8 illustrates entrance ends 102 of condensing tubes 101 arranged in two concentric rings, in accordance with one embodiment of the invention. The arrangement of condensing tubes 101 is shown as having two concentric rings, the inner ring having six condensing tubes 101 and the outer ring having twelve condensing tubes 101. This arrangement is the same pattern as holes 40 of orifice plate 15, and as pins 43 of valve member 16, which are described and shown in FIGS. 4 and 5. In the preferred embodiment, as previously discussed, condensing tubes 101 of condensing tube array 100 are arranged such that the longitudinal axes of condensing tubes 101 correspond to the longitudinal axes of pins 43 and the centerpoints of holes 40.

Figure 9:
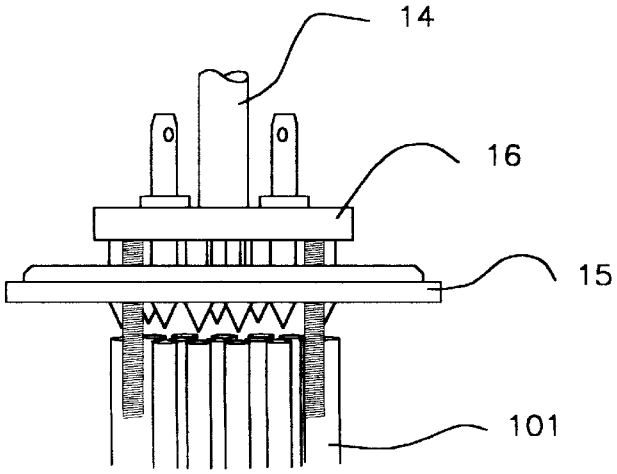
FIG. 9 is a view showing the pins of the valve member penetrating the holes of the orifice plate so as to be positioned relative to the entrance ends of the condensing tubes of the condensing tube array, in accordance with one embodiment of the present invention.

FIG. 9 is a view showing pins 43 of valve member 16 penetrating holes 40 of orifice plate 15 so as to be positioned relative to entrance ends 102 of condensing tubes 101, in accordance with one embodiment of the present invention. As shown, studs 108 contact orifice plate 15 in order to position entrance ends 102 of condensing tubes 101 a pre-determined distance from orifice plate 15. Conical tips 43*a* have penetrated holes 40 of orifice plate 15, and are disposed relatively close to entrance ends 102.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

It is to be understood that the drawings are not necessarily drawn to scale, but that they are merely conceptual in nature.

What is claimed is:

1. A fluid mixer for mixing a second fluid with a first fluid, said fluid mixer comprising:

a first body having a first fluid passageway extending between an inlet and an outlet, through which said first fluid flows;

a condensing tube array disposed within said first fluid passageway, said condensing tube array comprising a plurality of condensing tubes;

a second body having a second fluid passageway extending between an inlet and an outlet, through which said second fluid flows;

a connecting passageway communicating said first and second fluid passageways;

an orifice plate operatively arranged in said connecting passageway, said orifice plate having a plurality of holes through which said second fluid may flow into said first body, each of said plurality of holes having a centerpoint;

a valve member mounted for movement relative to said orifice plate, and comprising a plurality of pins equal in number to said plurality of holes, each of said plurality of pins having a longitudinal axis corresponding to a centerpoint of each of said plurality of holes, and each of said plurality of pins being cooperatively shaped relative to said plurality of holes.

2. The apparatus of claim 1, further comprising an actuator operatively arranged to move said valve member relative to said orifice plate, such that said plurality of pins of said valve member are configured relative to said plurality of holes of said orifice plate so as to selectively vary the flow therethrough.

3. The apparatus of claim 1, wherein said plurality of condensing tubes are secured relative to each other by a plurality of retaining rings, and wherein said plurality of condensing tubes are secured relative to said orifice plate by a plurality of studs.

4. The apparatus of claim 1, wherein said plurality of condensing tubes are equal in number to said plurality of holes.

5. The apparatus of claim 1, wherein each of said plurality of condensing tubes further comprises a longitudinal axis which corresponds to said longitudinal axis of a respective one of said plurality of pins and said centerpoint of a respective one of said holes.

6. The apparatus of claim 1, wherein each of said plurality of condensing tubes further comprises an entrance end, each of said entrance ends selectively positioned a distance from said orifice plate.

7. The apparatus of claim 3, wherein each of said plurality of studs further comprises a first end and a second end, and each of said plurality of retaining rings further comprises holes through which said studs can pass, said first end of each of said plurality of studs being operatively secured to said orifice plate and said condensing tube array being secured within said first fluid passageway of said first body by a plurality of fasteners located on said second end of said studs.

8. The apparatus of claim 3, wherein said condensing tube array further comprises a plurality of stud tubes for passing said studs therethrough.

9. The apparatus of claim 8, wherein said plurality of stud tubes are configured to secure said condensing tube array in a position relative to said orifice plate such that respective entrance ends of each said condensing tube is a pre-determined distance from said orifice plate.

10. The apparatus of claim 1, wherein each of said plurality of pins further comprises a conical tip portion.

11. The apparatus of claim 10, wherein each of said holes further comprises a frusto-conical mouth configured complementary with respect to said conical tip portions of said pins.

12. The apparatus of claim 1, wherein said second fluid comprises steam.

13. A condensing tube array, comprising:

a plurality of condensing tubes disposed within a first fluid passageway of a first body through which a first fluid flows, each of the said plurality of condensing tubes having a longitudinal axis and an entrance end;

a retaining ring, mounted to said plurality of condensing tubes, for securing said plurality of condensing tubes in relative position to each other, such that each said longitudinal axis of said plurality of condensing tubes corresponds to a centerpoint of a hole, a plurality of which are disposed within an orifice plate, said orifice plate operatively arranged between said first fluid passageway and a second fluid passageway of a second body through which a second fluid flows;

a plurality of studs for securing said plurality of condensing tubes relative to said orifice plate.

14. The apparatus of claim 13, wherein each of said plurality of studs further comprises a threaded end portion, and said orifice plate further comprises a plurality of threaded openings for receiving said threaded end portions of said plurality of studs.

15. The apparatus of claim 13, wherein said plurality of condensing tubes are equal in number to said plurality of holes in said orifice plate.

16. The apparatus of claim 13, wherein each of said entrance ends of said condensing tubes is selectively positioned a distance from said orifice plate.

17. The apparatus of claim 13, wherein said condensing tube array further comprises a plurality of stud tubes for passing said studs therethrough.

18. The apparatus of claim 17, wherein said plurality of stud tubes are configured to secure said condensing tube array in a position relative to said orifice plate such that respective entrance ends of each said condensing tube is a pre-determined distance from said orifice plate.

19. The apparatus of claim 13, wherein each of said plurality of studs comprises a first end and a second end, and each of said plurality of retaining rings further comprises holes through which said studs can pass, said first end of each of said plurality of studs being operatively secured to said orifice plate and said condensing tube array being secured within said first fluid passageway of said first body by a plurality of fasteners located on said second end of each of said plurality of studs.

20. The apparatus of claim 13, wherein said second fluid is steam.

* * * * *